United States Patent [19]

Taylor, Jr.

[11] 4,391,397

[45] Jul. 5, 1983

[54] FIREWOOD CARRIER

[76] Inventor: William D. Taylor, Jr., P.O. Box 142, King George, Va. 22485

[21] Appl. No.: 277,153

[22] Filed: Jun. 25, 1981

[51] Int. Cl.[3] ..... A45C 11/00

[52] U.S. Cl. ..... 224/265; 224/201

[58] Field of Search ..... 224/265, 266, 261, 186, 224/201, 272

[56] References Cited

U.S. PATENT DOCUMENTS

| | | | |
|---|---|---|---|
| 909,217 | 1/1909 | Presba et al. | 224/265 X |
| 2,557,556 | 6/1951 | Morris | 224/201 |
| 3,332,593 | 7/1967 | Fauser | 224/265 X |
| 3,940,040 | 2/1976 | Haulter | 224/201 X |

*Primary Examiner*—Steven M. Pollard

*Attorney, Agent, or Firm*—W. Brown Morton, Jr.

[57] ABSTRACT

A firewood carrier which is front mounted, enabling the wearer to both load and transport firewood with ease. One pair of the curved ends of this two S-shaped tubes device is padded and placed over the wearer's shoulders, leaving the other end of the device, which is braced by a plurality of crossbars and preferably covered in canvas, positioned in front of the wearer. This arrangement leaves the wearer's arms free to stack firewood onto the carrier.

1 Claim, 2 Drawing Figures

FIREWOOD CARRIER

BACKGROUND OF THE INVENTION

The present invention relates to a wood-carrying device, particularly to one for carrying firewood.

Prior art devices for carrying wood by suspending it from the wearer's shoulders are back-mounted, but because they are back-mounted, they do not enable a person to load the firewood and at the same time wear the firewood carrier. Examples are U.S. Pat. Nos. 909,217 and 1,027,401. Prior art devices for somewhat similar front-borne carriers have not been suited to carry firewood. Examples are U.S. Pat. Nos. 1,474,728, 2,557,556, and 3,940,040. The present invention not only overcomes these deficiencies, but provides other advantages as well, including simplicity in design, ease of construction, low cost, and durability.

SUMMARY OF THE INVENTION

The simplicity of this invention is such that the Abstract and the statement of the Background of the Invention, both here incorporated by reference, sufficiently summarize it.

PREFERRED EMBODIMENT

Figure 1:
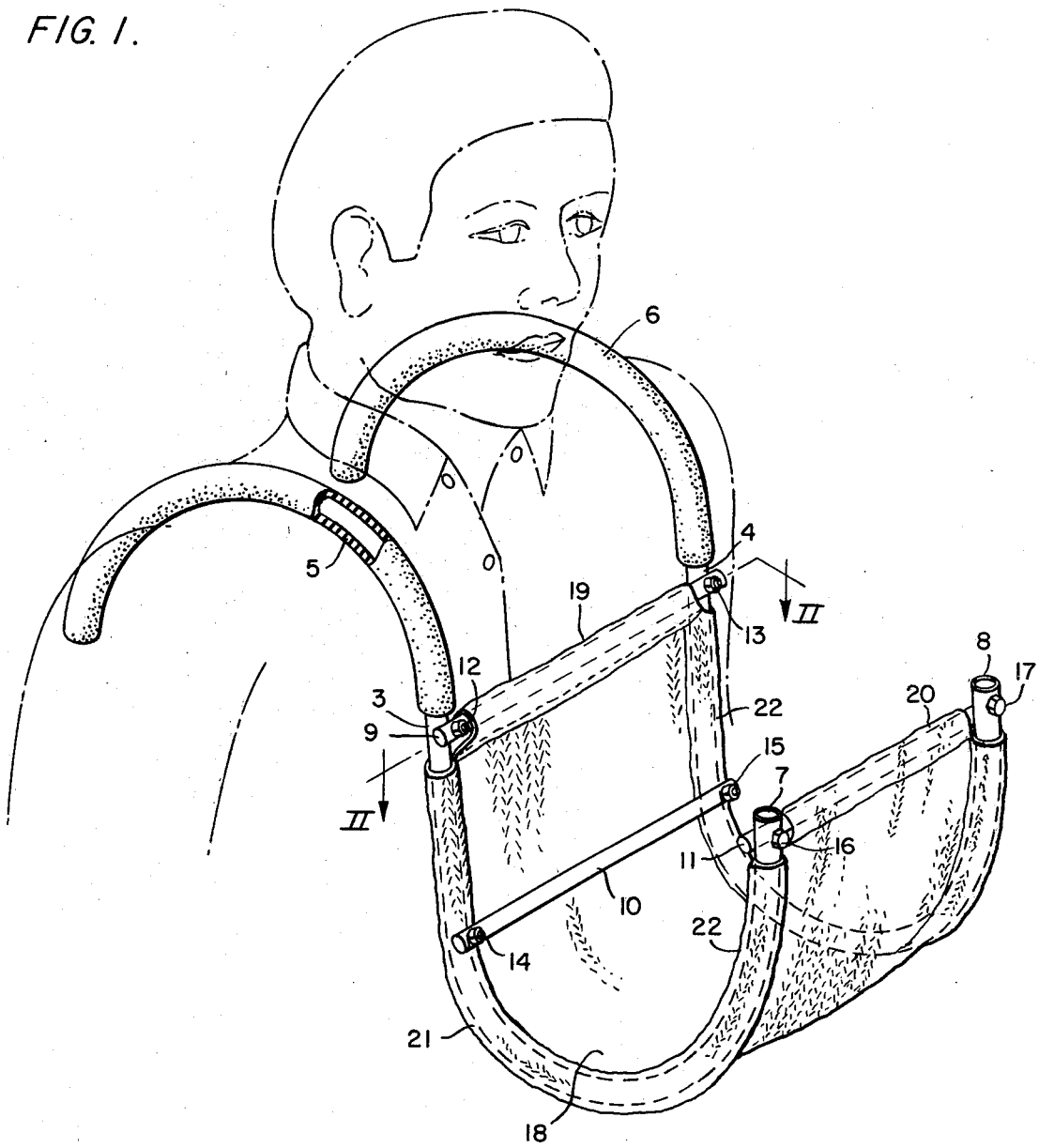
FIG. 1 is a perspective view showing the firewood-carrying device of this invention in use.
Figure 2:
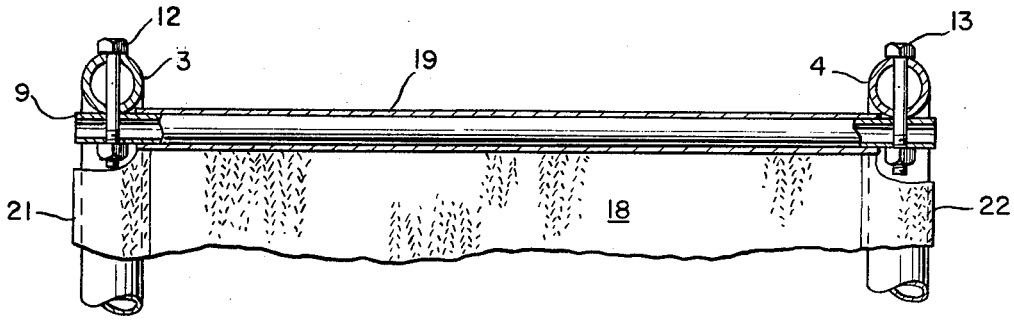
FIG. 2 is a top sectional view along a part of the plane II—II of FIG. 1.

Referring to FIGS. 1 and 2, the wood carrier consists essentially of a pair of S-shaped carrying components 3,4 made of a tubular rigid supporting material (e.g. conventional electrical conduit) arranged spaced apart in parallel planes. The upper "hook" of 3,4 is covered with a padded surface material, 5,6 (e.g., conventional hot water pipe insulation) and is configured to be suspended from the wearer's shoulders. Both the upper 3,4 and lower 7,8 portions of the device are, individually, C-shaped.

The lower portions 7,8 support and form part of the receptacle in which the firewood rests. Crossbar elements 9,10,11 space and brace these "S" shaped members and complete the receptacle structure. The crossbars are fastened at each end to the members 3,4 by bolts, 12,13,14,15,16,17. Canvas 18 covers the lower section, being stretched in the direction along the S from crossbar 9 under crossbar 10 to crossbar 11 and in the other direction from S to S from one lower portion 7 to the other, 8.

The canvas, generally designated 18, is not essential, but is to be preferred to bare tube construction. It is preferably sewed before assembly to provide a top sleeve 19 to accommodate crossbar 9, a bottom sleeve 20 to accommodate crossbar 11, and right and left side sleeves 21 and 22 to accommodate lower portions 7 and 8, respectively, of S-members 3 and 4.

The bolts 12,13,14 and 15, are preferably carriage bolts assembled to have their smooth heads adjacent the wearer. Bolts 16 and 17 are also therefore preferably like carriage bolts so that, for simplicity, all bolts used are interchangeable. It is not necessary to provide square apertures to accommodate the carriage bolts heads as they will wedge into place on tightening if the round holes provided to accommodate the bolt shanks are a slack fit It is a prime feature of the wood carrier of this invention that is completely made of stock materials obtainable anywhere in the United States and requires only the simplest tools and fixtures to make and assemble the parts. The S-members 3 and 4 and the cross-members 9, 10, 11 are cut from electrical conduit which can be readily bent to form the upper and lower C-shaped portions by well-understood techniques. All members are drilled or punched to provide the bolt holes, preferably before shaping and assembly. Canvas sleeves 21 and 22 are first slid over lower C-portions 7 and 8. Crossbars 9 and 11 are then slid into sleeves 19 and 20 and bolted to the S-members 3 and 4. The bolting-on of crossbar 10 and the sliding-on of paddings 5 and 6 complete the assembly. By the way of example merely, one satisfactory wood carrier according to the invention has been made with the lower C-portions having a radius of 6 inches and the upper C-portions, a radius of 4-$\frac{1}{2}$ inches. The S-members were spaced about 12 inches apart.

I claim:

1. A device for carrying wood, particularly firewood, comprising a front-carried frame formed of a pair of rigid, generally S-shaped, tubular elements formed of conventional electrical conduit, spaced apart in parallel planes by a plurality of rigidly attached cross members, the upper curvatures of the S-elements being configured in downwardly-concave C-portions, padded with conventional hot water pipe insulation to rest on the shoulders of the wearer of the device, the lower curvatures of the S-elements being configured in upwardly-concave C-portions to form a receptacle for the transportation of firewood, and the lower curvatures and two cross-members being covered with canvas sleeves attaching to them a canvas sheet which forms a part of the receptacle.

* * * * *